US010625130B1

(12) United States Patent
McDowell

(10) Patent No.: US 10,625,130 B1
(45) Date of Patent: Apr. 21, 2020

(54) FLIP TOY ASSEMBLY WITH LAUNCHER DEVICE AND PROJECTILE

(71) Applicant: Charles N. McDowell, Newtown Square, PA (US)

(72) Inventor: Charles N. McDowell, Newtown Square, PA (US)

( * ) Notice: Subject to any disclaimer, the term of this patent is extended or adjusted under 35 U.S.C. 154(b) by 0 days.

(21) Appl. No.: 15/337,638

(22) Filed: Oct. 28, 2016

Related U.S. Application Data

(60) Provisional application No. 62/247,942, filed on Oct. 29, 2015.

(51) Int. Cl.
*A63B 67/00* (2006.01)
*A63B 67/06* (2006.01)

(52) U.S. Cl.
CPC ..... *A63B 67/06* (2013.01); *A63B 2067/063* (2013.01)

(58) Field of Classification Search
CPC ..... A63B 65/12; A63B 65/122; A63B 65/10; A63B 43/002; A63B 59/30; A63B 67/06; A63B 2067/063
See application file for complete search history.

(56) References Cited

U.S. PATENT DOCUMENTS 442,675 A 12/1890 Wilcox
1,038,429 A * 9/1912 Penny ..... A63B 53/04 273/129 R
2,002,631 A * 5/1935 Fiondella ..... A63F 9/0252 124/5
2,076,010 A * 4/1937 String ..... A63B 67/06 273/338
2,120,075 A 6/1938 Roosman
2,365,513 A * 12/1944 Bartle ..... A63B 67/06 273/339
2,408,160 A 9/1946 Brunner
2,811,812 A * 11/1957 Bishop ..... A63H 33/02 446/450
3,049,352 A 8/1962 Hancock
3,095,867 A 7/1963 Kiyuna
3,176,673 A * 4/1965 Dill ..... A63B 59/30 124/5
3,357,705 A * 12/1967 Blanchard ..... A63B 43/00 473/280
3,413,755 A * 12/1968 Mishler ..... A63F 7/2472 273/129 Q
3,578,332 A * 5/1971 Caldwell ..... A63B 53/0487 473/249

(Continued)

FOREIGN PATENT DOCUMENTS

DE 2355845 5/1975
GB 471264 9/1937

*Primary Examiner* — Melba Bumgarner
*Assistant Examiner* — Amir Klayman
(74) *Attorney, Agent, or Firm* — Joseph E. Maenner; Maenner & Associates, LLC

(57) ABSTRACT

A flip toy assembly provides a launcher having and a projectile that is launched and can be caught by the launcher. The launcher has an elongate handle. The handle has a top end and a bottom end, distal from the top end. A head is fixedly attached to the bottom end. A projectile has an apex having a first side and a second side. A first leg extends away from the first side of the apex and a second leg extends away from the second side of the apex. A method of playing a game with the flip toy assembly is also provided.

6 Claims, 23 Drawing Sheets

(56) References Cited

U.S. PATENT DOCUMENTS 3,625,517 A * 12/1971 Durnack ..... A63B 53/007 473/313
3,701,531 A * 10/1972 Bowers ..... A63B 67/06 273/343
3,851,880 A * 12/1974 Ritch ..... A63B 59/00 273/108
RE28,467 E * 7/1975 Curtiss ..... A63B 67/06 273/339
4,070,792 A * 1/1978 Vuyovich ..... A63H 33/02 446/170
4,204,684 A * 5/1980 Molitor ..... A63B 53/04 473/349
4,325,550 A * 4/1982 Thompson ..... A63B 53/007 473/313
4,805,916 A 2/1989 Zentner, Jr.
4,881,737 A * 11/1989 Mullins ..... A63B 53/065 403/84
5,290,035 A * 3/1994 Hannon ..... A63B 53/007 473/252
5,294,129 A * 3/1994 Brown ..... A63B 59/20 273/343
5,337,995 A 8/1994 Satoh et al.
5,375,848 A * 12/1994 Coleman ..... A63B 43/00 273/DIG. 30
5,465,704 A 11/1995 Kohl
5,522,597 A * 6/1996 Hanks ..... A63B 65/12 273/343
D398,351 S * 9/1998 Sheets ..... D21/736
5,879,251 A * 3/1999 Rose ..... A63B 65/00 473/576
6,076,829 A 6/2000 Oblack
6,435,979 B1 * 8/2002 Mounfield, Jr. ..... A63B 53/04 473/324
7,665,453 B1 2/2010 D'Agostino
D618,742 S * 6/2010 Sanderson ..... D21/736
7,963,858 B2 * 6/2011 Sanderson ..... A63B 53/02 473/314
8,015,968 B2 9/2011 Christ
8,539,939 B2 9/2013 Minneman et al.
D702,780 S * 4/2014 Marion ..... D21/722
8,973,564 B1 3/2015 Saber et al.
8,979,091 B2 * 3/2015 Darragh ..... A63B 67/06 273/343
2005/0070198 A1 3/2005 Pickering et al.
2008/0224408 A1 * 9/2008 Eisenbarth ..... A63B 63/00 273/343
2009/0203458 A1 * 8/2009 Presley ..... A63B 63/00 473/157
2010/0216579 A1 8/2010 Williams
2011/0037226 A1 * 2/2011 Nickles ..... A63B 43/06 273/343
2014/0162807 A1 * 6/2014 Touchette ..... A63B 53/02 473/314
2015/0013653 A1 1/2015 Clarke et al.
2015/0018129 A1 * 1/2015 Van Alen ..... A63B 67/02 473/409
2015/0136101 A1 5/2015 Jensen
2015/0224378 A1 8/2015 Ruyssenaars et al.

* cited by examiner

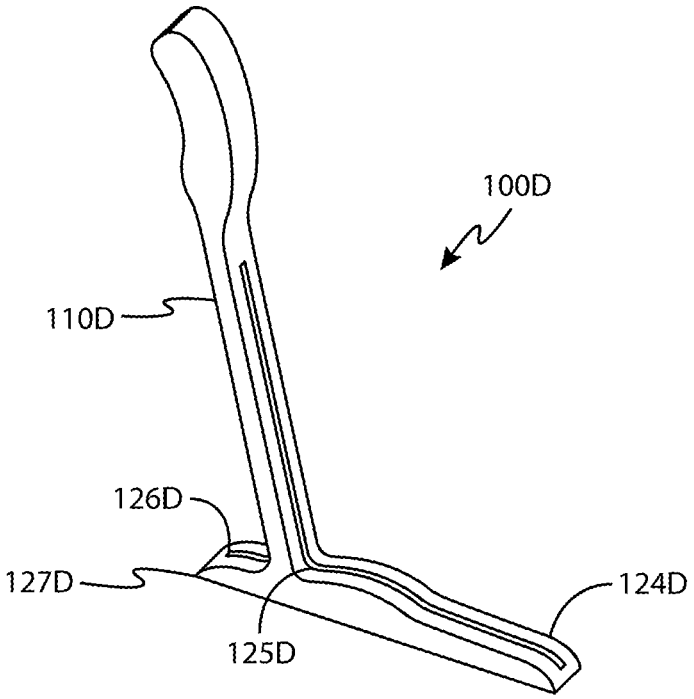
FIG. 2DD
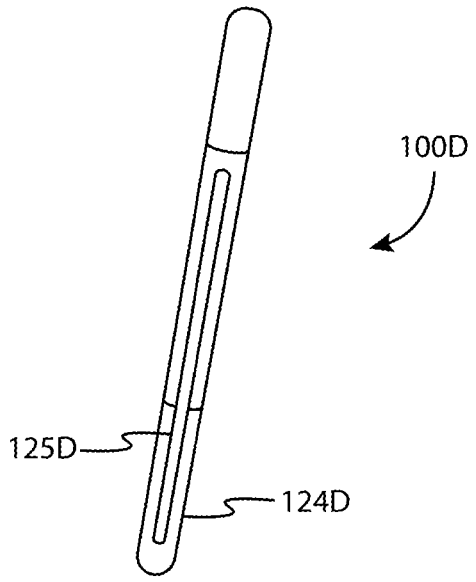
FIG. 2DDD

FLIP TOY ASSEMBLY WITH LAUNCHER DEVICE AND PROJECTILE

CROSS-REFERENCE TO RELATED APPLICATION

This application claims priority from U.S. Provisional Patent Application Ser. No. 62/247,942, filed on Oct. 29, 2015, which is incorporated by reference herein in its entirety.

BACKGROUND OF THE INVENTION

Throw and catch toys are well known to provide entertainment for both humans and animals. It would be beneficial to provide a throw and catch toy that can be used by a single person, multiple, people, or even a person and an animal, such as a dog.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Briefly, the present invention provides a flip toy assembly having a launcher having and a projectile that is launched and can be caught by the launcher. The launcher has an elongate handle. The handle has a top end and a bottom end, distal from the top end. A head is fixedly attached to the bottom end. A projectile has an apex having a first side and a second side. A first leg extends away from the first side of the apex and a second leg extends away from the second side of the apex.

The present invention also provides a method of playing a game using the launcher and the projectile, along with a frame adapted to catch the projectile.

BRIEF DESCRIPTION OF THE DRAWINGS

Aspects, features, and advantages of the present invention will become more fully apparent from the following detailed description, the appended claims, and the accompanying drawings in which like reference numerals identify similar or identical elements.

FIG. 2BB shows a sectional view of another alternative exemplary embodiment of the head end of the launcher/retrieval device shown in FIG. 1, with the projectile shown in FIG. 2B loaded thereon;

FIG. 2CC shows a sectional view of yet another alternative exemplary of the head end of the launcher/retrieval device shown FIG. 1, with projectile shown in FIG. 2C loaded thereon;

FIG. 2DD is a perspective view of an exemplary embodiment of a launcher/retrieval device according to the present invention. They can be used with the projectile shown in FIG. 2D;

FIG. 2DDD is a side elevational view of the launcher/retrieval device shown FIG. 2DD;

DETAILED DESCRIPTION OF THE INVENTION

Figure 1:
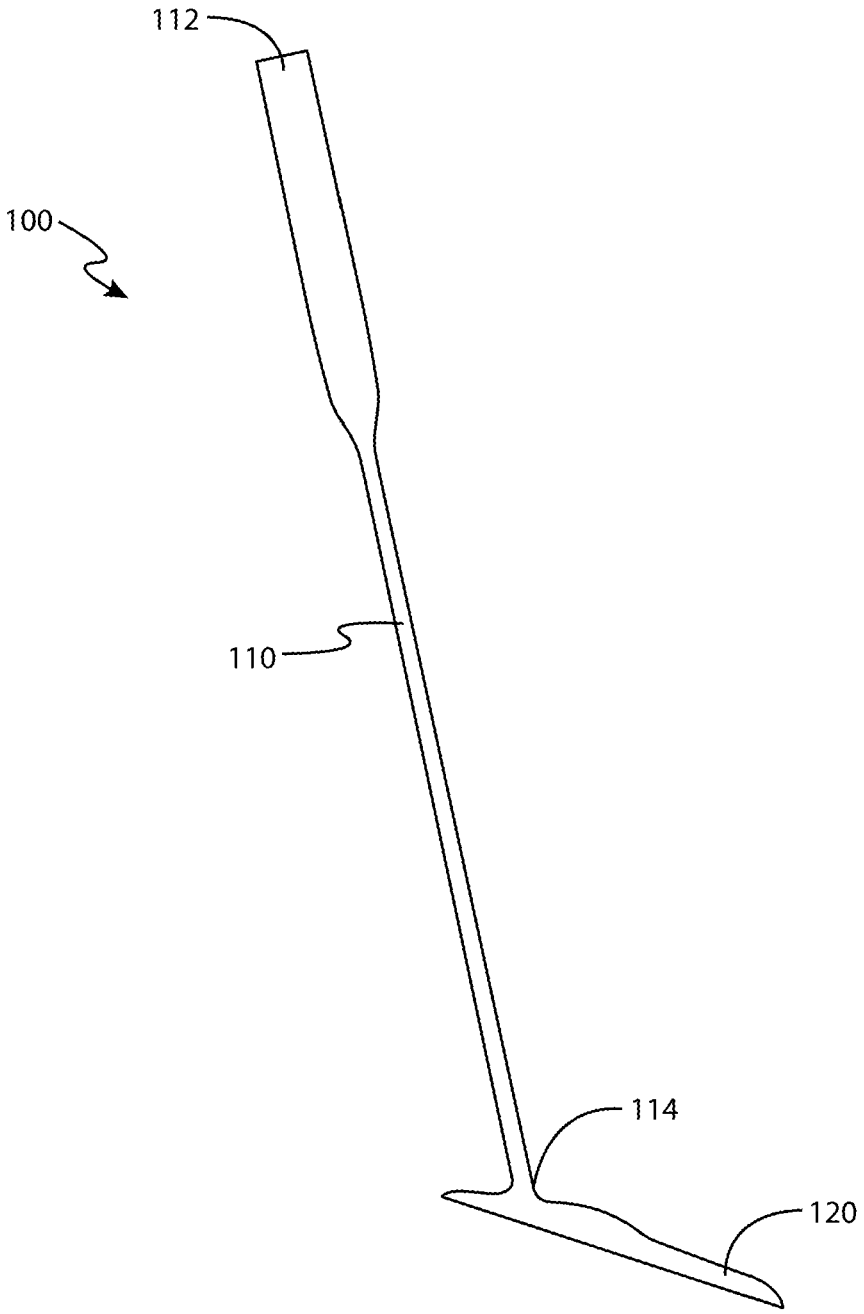
FIG. 1 shows a side elevational view of a launcher/retrieval device according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

FIG. 1 shows a launcher/retrieval device 100 according to an exemplary embodiment of the present invention that is shaped similar to a golf club, such as, for example, a putter. Device 100 includes a handle 110 having a top end 112, a bottom end 114, and a head 120 attached to bottom end 114. Optionally, top end 112 can include a wrist strap (not shown) to prevent a user from inadvertently dropping or throwing launcher/retrieval device 100 during use. In exemplary embodiment, handle 110 extends for a length of about 27 inches, although those skilled in the art will recognize that handle 110 can extend for different lengths as well. Launcher/retrieval device 100 is used to launch and/or retrieve a projectile, such as, for example, any of the projectiles shown in any of FIGS. 4-10C.

Figure 1A:
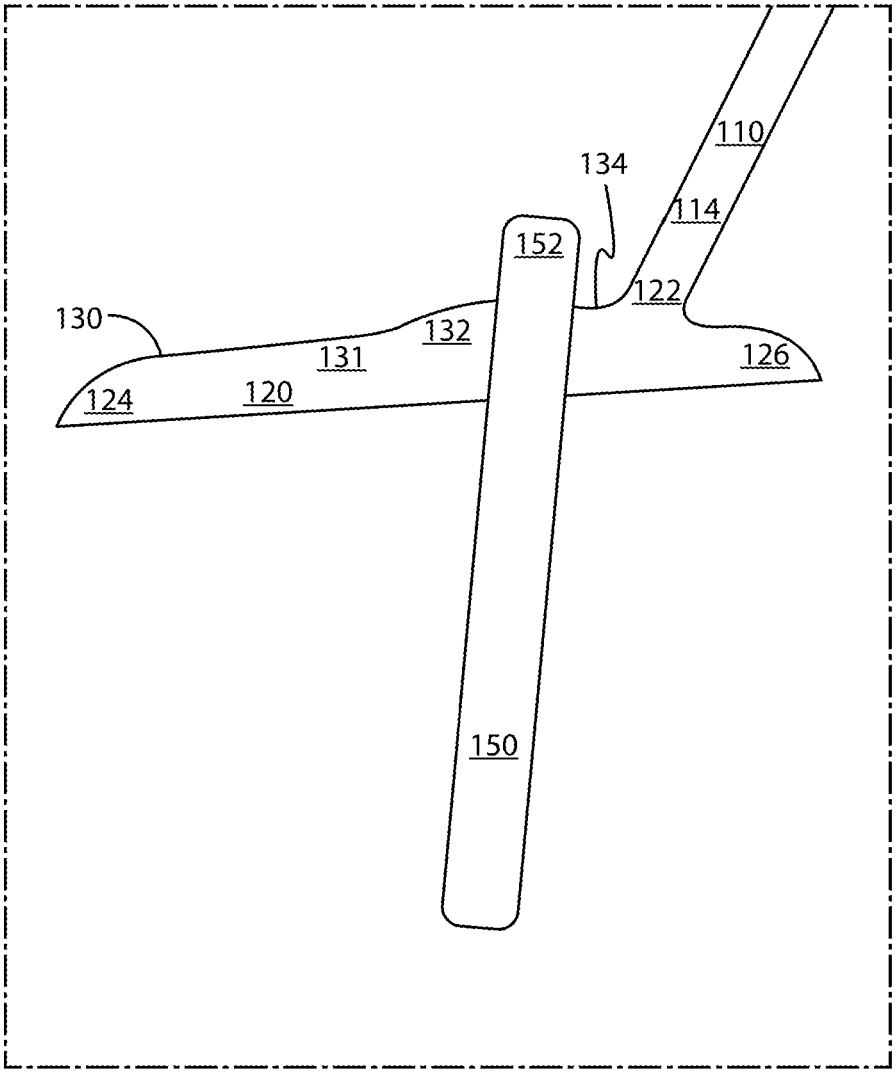
FIG. 1A shows a side elevational view of the launcher/retrieval device shown FIG. 1, with a projectile according to an exemplary embodiment of the present invention mounted thereon.

FIG. 1A shows a projectile 150 (shown FIG. 4) loaded on launcher/retrieval device 100. While projectile 150 is shown with respect to launcher/retrieval device 100, those skilled in the art will recognize that projectile 150 can be used with other embodiments of launcher/retrieval devices disclosed below, and, conversely, other projectiles can also be used with launcher/retrieval device 100 and the other embodiments of launcher/retrieval devices disclosed below. Launcher/retrieval device 100 is used to launch a projectile 150 in the air, either away from the user for another party to catch and/or retrieve with another launcher/retrieval device 100, or proximate to the user for the user to catch on launcher/retrieval device 100. Optionally, handle 110 can be torsionally twisted about a longitudinal axis to help correct the flight of projectile 150 in the event that projectile 150 travels in a direction oblique to its launch direction.

Figure 2:
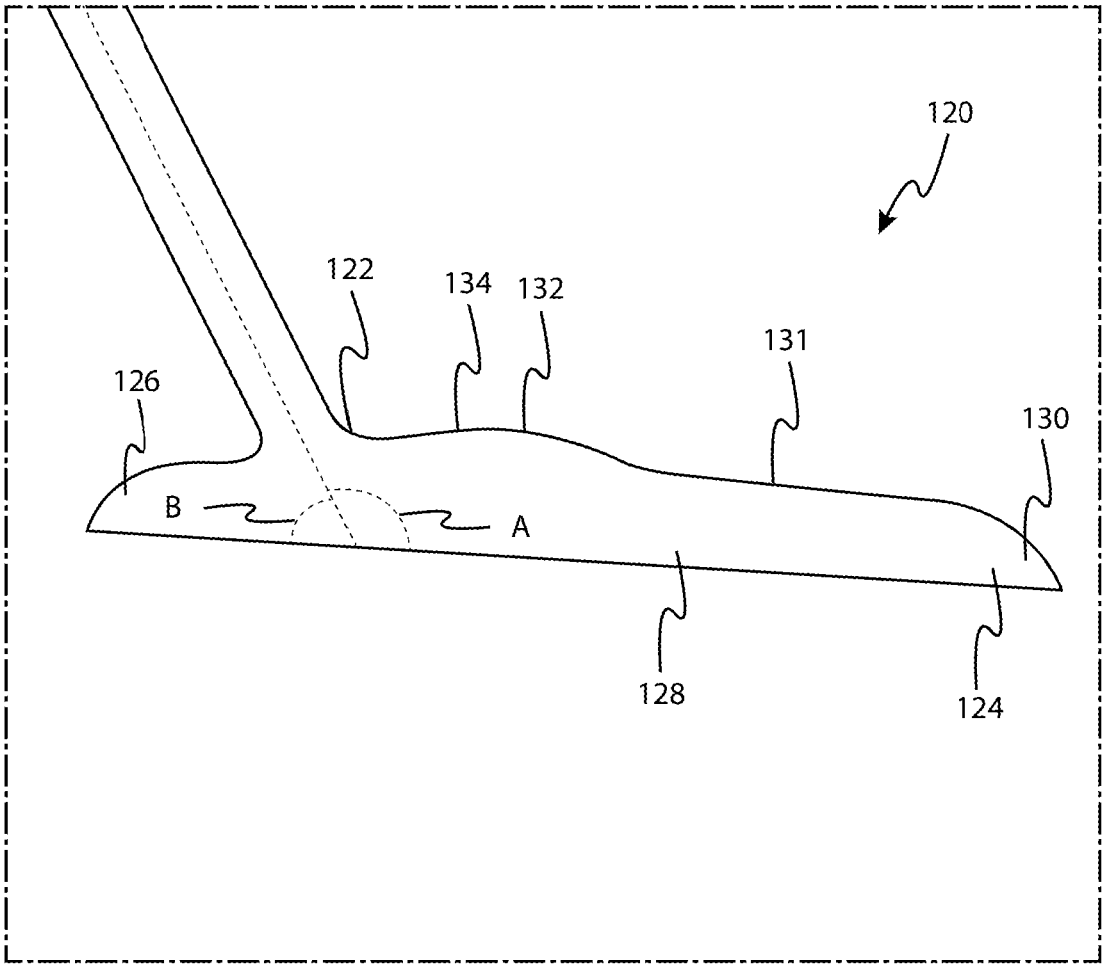
FIG. 2 shows an enlarged view of a head end of the launcher/retrieval device shown in FIG. 1.

Referring to FIG. 2, head 120 includes a connector portion 122 that is connected to the bottom end 114 of handle 110. A first free end 124 of head 120 extends in a first direction from connector portion 122 at an angle A of about 125°, although those skilled in the art will recognize that angle A can be more or less than 125°. In an exemplary embodiment, first free end 124 extends for a distance of about 7 inches, although those skilled in the art will recognize the first free end 124 can extend for a distance of more or less than about 7 inches.

A second free end 126 of head 120 extends in a second direction from connector portion 122 at an angle B of about 55°, although those skilled in the art will recognize that angle B can be more or less than 55°, such that a bottom end of head 120 extends in a generally flat, straight line between first free end 124 and second free end 126. In an exemplary embodiment, second free end 126 extends for distance of about 1½ inches, although those skilled in the art will recognize that second free end 126 can extend for a distance of more or less than about 1½ inches.

First free end 124 includes a generally sloped upward end 130 that generally flattens to an intermediate portion 131 and then rises to a convex hump 132 before settling into a concave receiver 134 adjacent connector portion 122. Second free end 126 sloped upward toward connector portion 122.

Figure 2A:
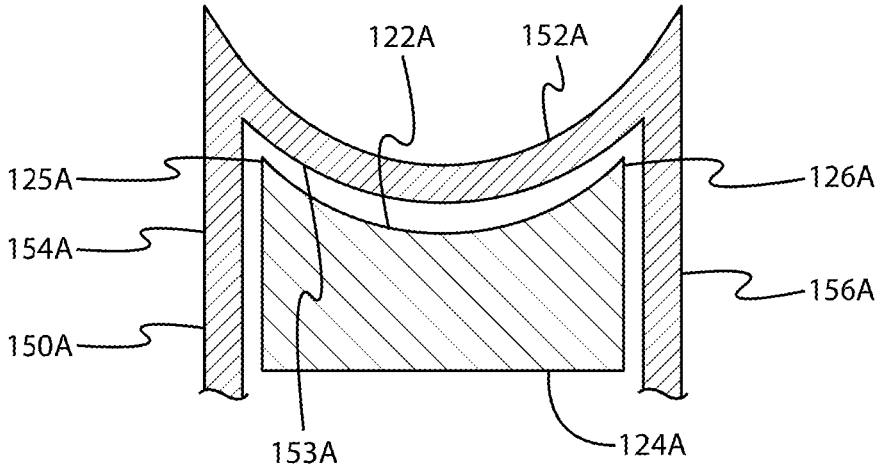
FIG. 2A shows a sectional view of an alternative exemplary embodiment of the head end of the launcher/retrieval device shown in FIG. 1, with an exemplary projectile loaded thereon.

Referring to FIG. 2A, an alternative embodiment of a first free end 124A that can be incorporated into launcher/retrieval device 100 is shown. First free end 124A can have a concave top surface 122A with relatively sharp edges 125A, 126A.

A projectile 150A that can be used with launcher/retrieval device 100 having first free end 124A has an apex 152A having a lower surface 153A that is convex in shape and corresponds with concave top surface 122A, such that, when projectile 150A is loaded onto first free end 124A, apex 152A nestles within top surface 122A. Additionally, the junction between apex 152A and arms 154A and 156A of projectile 150A can be relatively sharp as well to correspond to sharp edges 125A, 126A on first free end 124A. The concavity of top surface 122A and the corresponding shape of apex 152A can provide additional stability for projectile 150A as projectile 150A is cradled on first free end 124A.

Figure 2B:
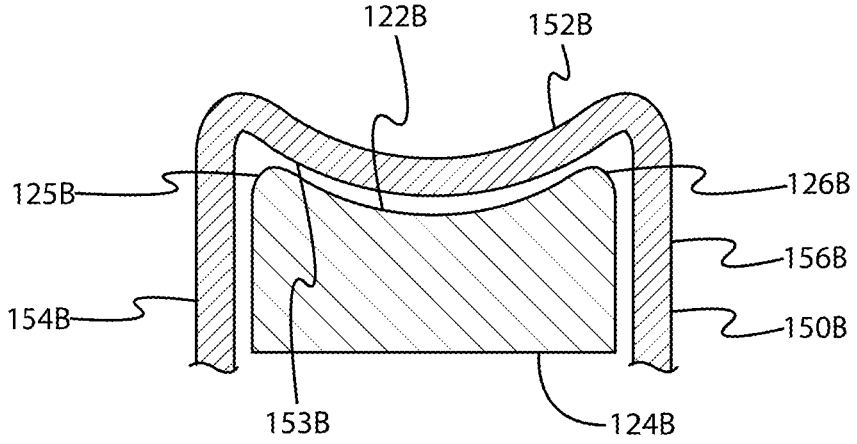
FIG. 2B shows a sectional view of another alternative exemplary embodiment of the head end of the launcher/retrieval device shown in FIG. 1, with an alternative exemplary projectile loaded thereon.

Similarly, referring to FIG. 2B, another alternative embodiment of a first free end 124B that can be incorporated into launcher/retrieval device 100 is shown. First free end 124B can have a concave top surface 122B with rounded convex edges 125B, 126B.

Referring to FIG. 2BB, yet another alternative embodiment of a first free end 124BB that can be incorporated into launcher/retrieval device 100 is shown. First free end 124BB can have a concave bottom surface 123BB with round or convex edges 127BB, 129BB.

A projectile 150B that can be used with launcher/retrieval device 100 having first free end 124B has an apex 152B having a lower surface 153B that is convex in shape and corresponds with concave top surface 122B, such that, when projectile 150B is loaded onto first free end 124B, apex 152B nestles within top surface 122B. Additionally, the junction between apex 152B and arms 154B and 156B of projectile 150B can be rounded as well to correspond to rounded edges 125B, 126B on first free end 124B. Similar to above, the concavity of top surface 122B and the corresponding shape of apex 152B can provide additional stability for projectile 150B as projectile 150B is cradled on first free end 124B. Still similarly, referring to FIG. 2C, still another alternative embodiment of a first free end 124C that can be incorporated into launcher/retrieval device 100 is shown. First free end 124C can have a convex top surface 122C and projectile 150C can have an apex 152C that has a generally concave inner surface 153C that corresponds to the surface contour of convex top surface 122C. Similar to above, the convex top surface 122C and the corresponding shape of apex 152C can provide additional stability for projectile 150C as projectile 150C is cradled on first free end 124C.

Figure 2C:
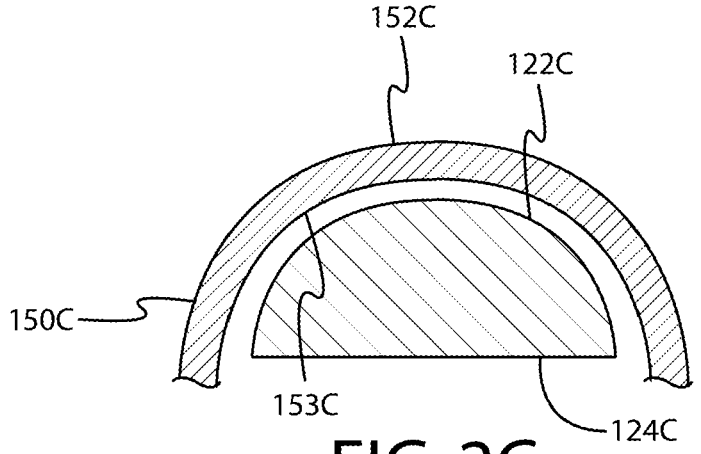
FIG. 2C shows a sectional view of still another alternative exemplary embodiment of the head end of the launcher/retrieval device shown in FIG. 1, with still another alternative exemplary projectile loaded thereon.
Figure 2B:
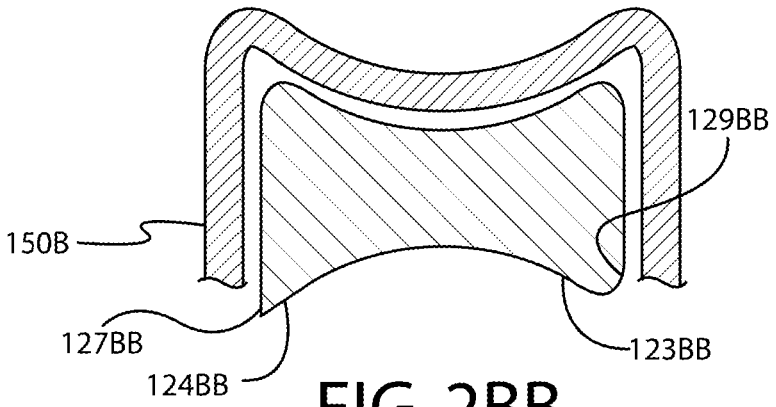
Figure 2C:
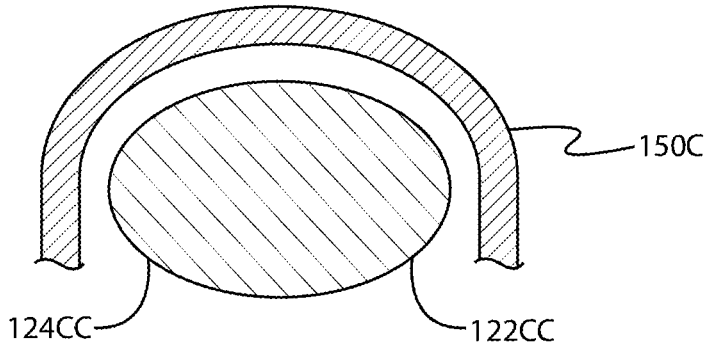

Referring to FIG. 2CC, yet another alternative embodiment of a first free end 124CC that can be incorporated into launcher/retrieval device 100 is shown. First free end 124CC can have a convex bottom surface 122CC.

Figure 2D:
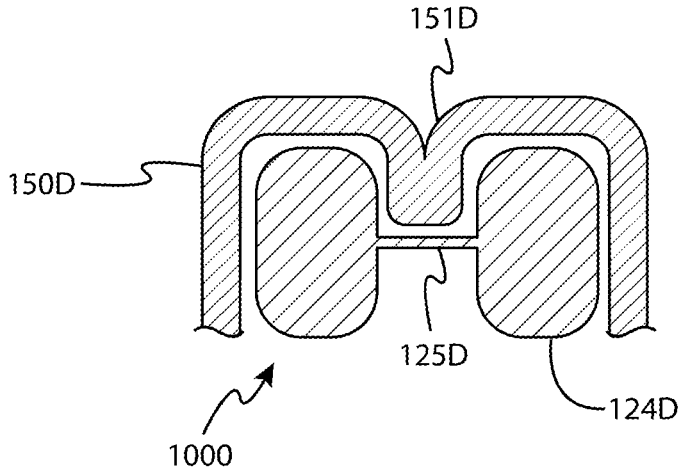
FIG. 2D shows a sectional view of another alternative exemplary embodiment of the head end of the launcher/retrieval device shown in FIG. 1, with yet another alternative exemplary projectile loaded thereon.

Referring to FIG. 2D, still another alternative embodiment of the first free end 124D that can be incorporated into a launcher/retrieval device 100D according to an exemplary embodiment of the present invention is shown. First free end 124D includes a longitudinal slot 125D that extends at least partially along the length of first free end 124D. A projectile 150D can be shaped similarly to projectile 150C, but with a central rib 151D that is sized to fit into slot 125D. As shown FIG. 2D, slot 125D extends along both the top surface and a bottom surface of first free end 124D.

As shown FIGS. 2DD and 2DDD, slot 125D can extend the entire length of first free end 124D, as well as at least partially along handle 110D. Also, as shown FIG. 2DDD, a slot 126D can also extend along the top of second free end 127D. The slots and corresponding central rib 151D allow projectile 150D to ride up along launcher/retrieval device 100D, allowing the user to perform tricks with projectile 150D.

Figure 3:
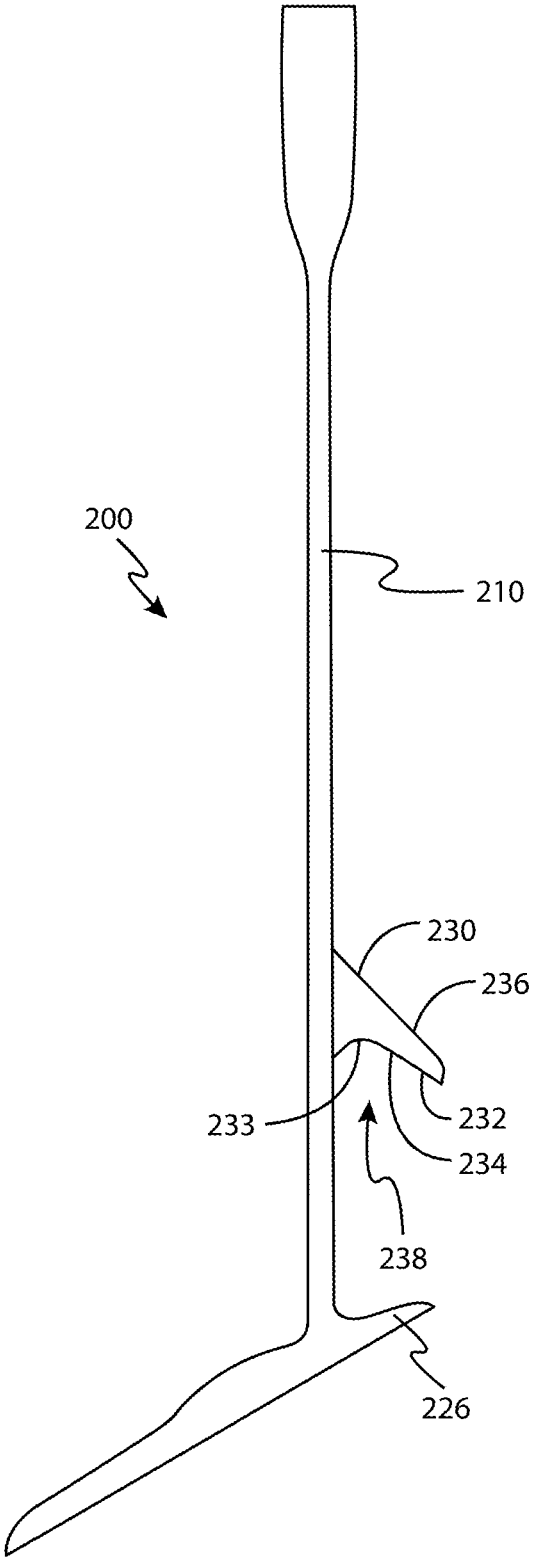
FIG. 3 shows a side elevational view of an alternative exemplary embodiment of a launcher/retrieval device according to the present invention.

Referring to FIG. 3, a second exemplary embodiment of a launcher/retrieval device 200 according to the present invention is shown. Launcher/retrieval device 200 is similar to launcher/retrieval device 100 discussed above with the addition of a hook 230 that extends rearward from handle 210. Hook 230 includes a downward sloping face 232. Optionally, hook 230 can also include an upward sloping face 233 that extends upwardly and away from handle 210 such that an apex 234 is formed at the intersection of downward sloping face 232 and upward sloping face 233. Still optionally, hook 230 can include a top surface 236 that slopes downwardly and away from handle 210.

As shown in FIG. 3, a vertical space 238 is formed alongside handle 210 between second free end 226 and hook 230. Vertical space 238 allows a projectile according to the present invention to be mounted on a second free end 226 and to allow movement of the projectile upward along handle 210 only until the projectile engages hook 230, restricting the ability of the projectile to move farther vertically upward along handle 210 and potentially inadvertently strike the user or another party standing close to the user. Hook 230 can be located anywhere along the length of handle 210 above second free end 226.

Figure 3A:
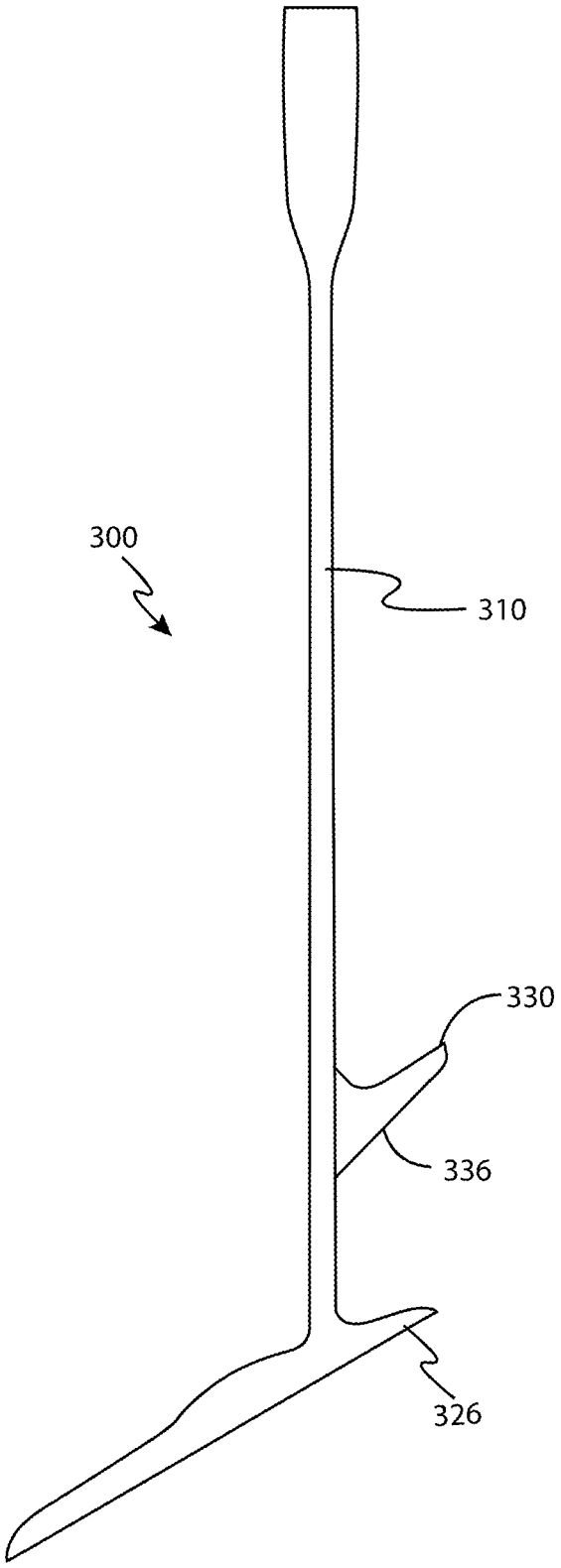
FIG. 3A shows a side elevational view of still another alternative exemplary embodiment of a launcher/retrieval device according to the present invention.

Referring to FIG. 3A, a third exemplary embodiment of a launcher/retrieval device 300 according to the present invention is shown. Launcher/retrieval device 300 is similar to launcher/retrieval device 200 discussed above, the exception that hook 330, which is similar to hook 230, is reversed, resulting in a bottom surface 336 being sloped upwardly and away from handle 310 to deflect a projectile that may have been inadvertently thrust upwardly from second free end 326 away from the user. Optionally, hook 330 can be removable and reinstallable onto launcher/retrieval device 300 such that launcher/retrieval device 200 is formed.

Optionally, each of launcher/retrieval device 100, 200, 300 may include a plurality of voids or holes formed throughout. A first advantage of the presence of the voids is to reduce the total weight of launcher/retrieval device 100, 200, 300. A second advantage of the voids, particularly in handles 110, 210, 310, is to impart additional flexibility to handles 110, 210, 310, which may provide the user with the ability to perform additional tricks, stunts, or maneuvers with launcher/retrieval device 100, 200, 300.

FIGS. 4-10 show exemplary embodiments of projectiles that can be used with launcher/retrieval devices 100, 200, 300 according to the present invention. While exemplary projectiles are shown, those skilled in the art will recognize that other types of projectiles may be used within the scope of the present invention.

Figure 4:
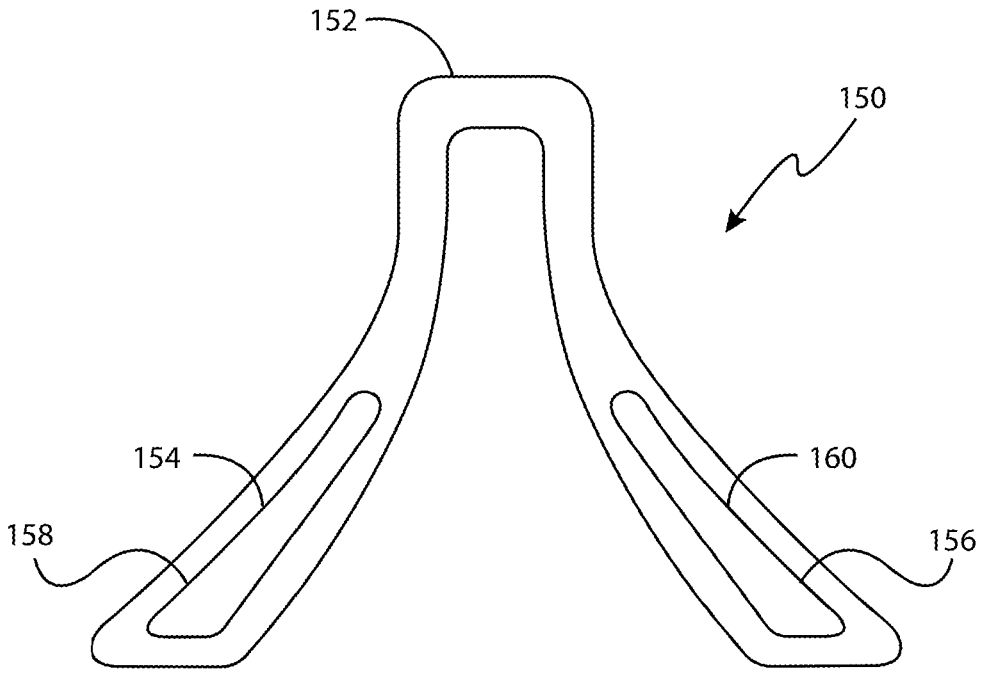
FIG. 4 shows a side elevational view of an exemplary embodiment of a projectile for use with any disclosed embodiment of the launcher/retrieval device according to the present invention.

Referring to FIG. 4, a first exemplary embodiment of a projectile 150 according to the present invention is shown. Projectile 150 is retained on head 120 and launched by a user by flicking handle 110.

Figure 4A:
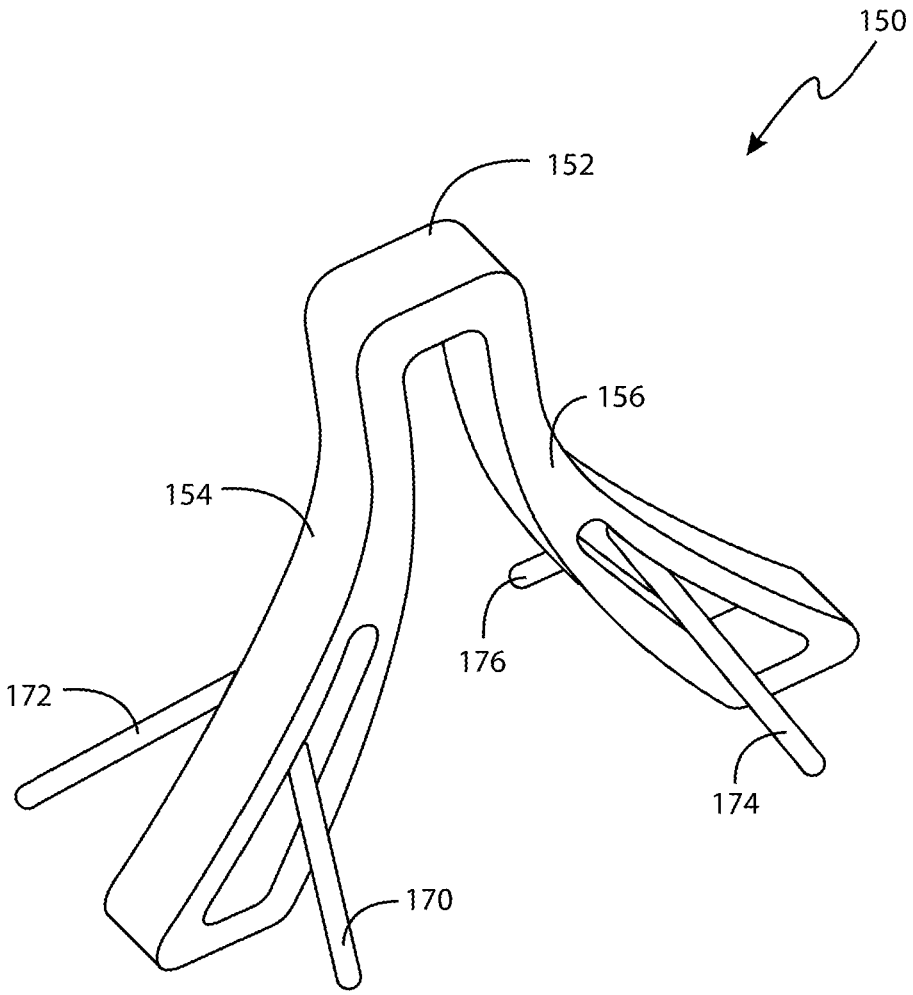
FIG. 4A shows a perspective view of yet another alternative exemplary embodiment of a projectile for use with any disclosed embodiment of the launcher/retrieval device according to the present invention.

Referring to FIG. 4A, supports 170, 172 extend outwardly from either side of arm 154 and supports 174, 176 extend outwardly from either side of form 156. Supports 170, 172, 174, 176 allow projectile 150 to stand upright. Optionally, supports 170, 172, 174, 176 can be constructed from glow sticks that allow projectile 150 to be seen in the dark.

In an exemplary embodiment, projectile 150 includes a generally flat apex 152 having a length that is about as wide as head 120. A longitudinal centerline 153 bisects projectile 150. Arms 154, 156 are generally curved to extend away from apex 152 and generally diverge away from centerline 153. In an exemplary embodiment, material is removed from each of arms 154, 156, forming holes 158, 160, respectively. Holes 158, 156 assist in weight distribution to balance projectile 150.

Figure 5:
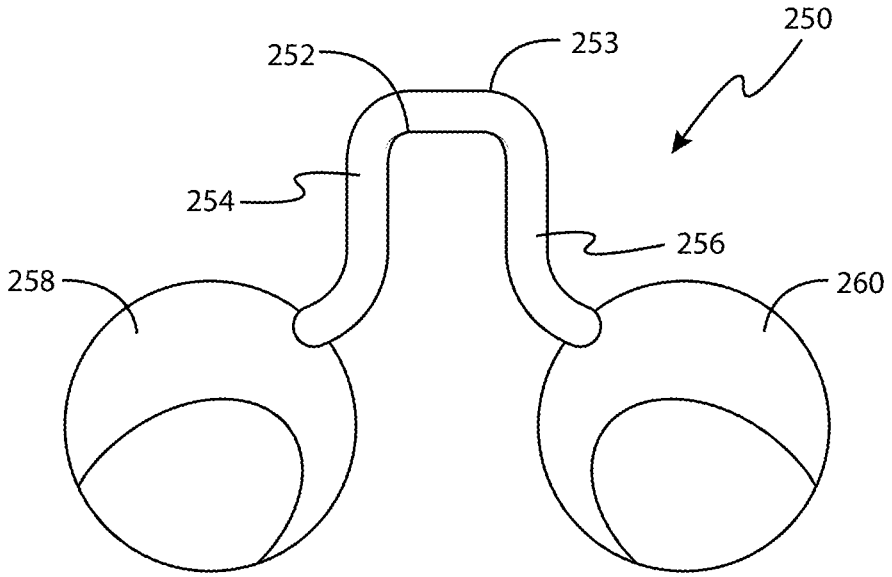
FIG. 5 shows a side elevational view of an alternative exemplary embodiment of a projectile for use with any disclosed embodiment of the launcher/retrieval device according to the present invention.

Referring to FIG. 5, an alternative embodiment of a projectile 250 is shown. Projectile 250 includes a generally flat apex 252 having a length that is about as wide as head 120. A longitudinal centerline 253 bisects projectile 250. Arms 254, 256 are generally curved to extend away from apex 252 and generally divert away from centerline 253. Instead of, or on addition to, holes 158, 156, however, distal ends of arms 254, 256 include spheres 258, 260, such as, for example, tennis balls, sponge balls, or other relatively soft material.

Still alternatively, apex 252 can be constructed from a rigid material, such as a high density plastic, while arms 254, 256 can be constructed from a soft material, such as a rubber, a sponge, or other similar material. Still alternatively, arms 234, 256 can also be constructed from a rigid material, and covered with a soft material.

Figure 6:
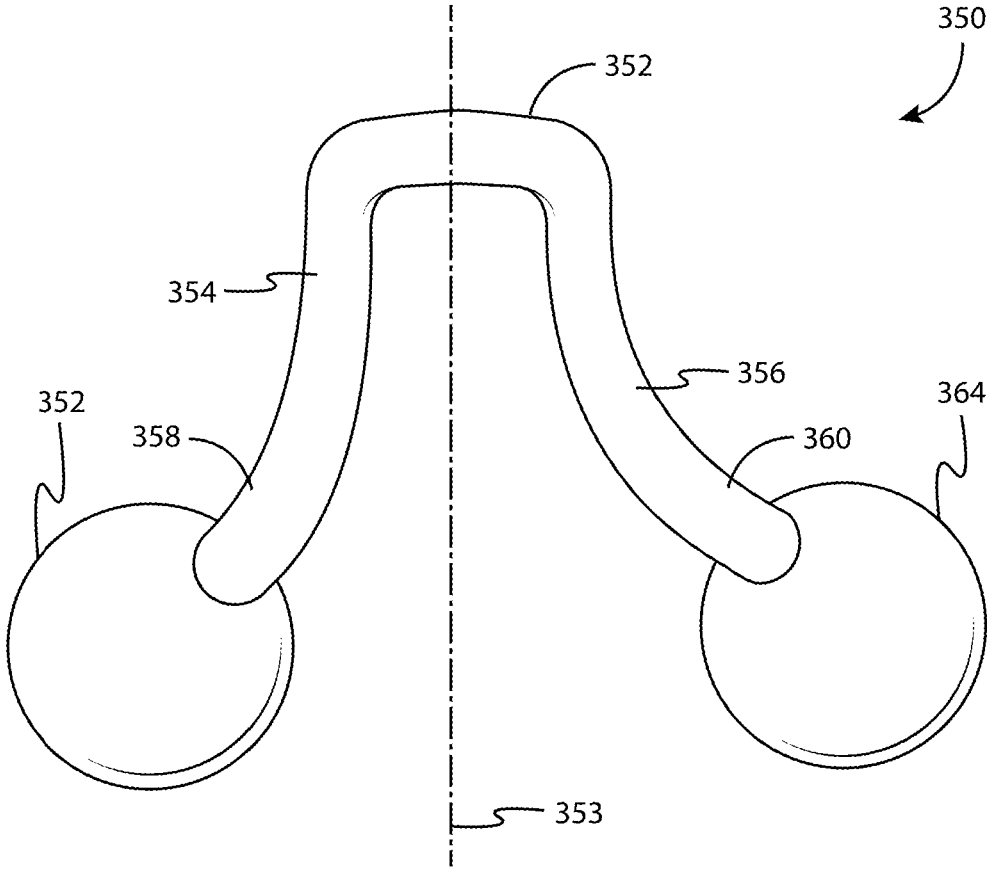
FIG. 6 shows a side elevational view of another alternative exemplary embodiment of a projectile for use with any disclosed embodiment of the launcher/retrieval device according to the present invention.

Referring to FIG. 6, an alternative embodiment of a projectile 350 is shown. Projectile 350 includes a generally flat apex 352 having a length that is about as wide as head 120. A longitudinal centerline 353 bisects projectile 250. Arms 354, 356 are generally straight and extend away from apex 252 and generally parallel to centerline 253. Arm extensions 358, 360 extend from their respective arms 354, 356, away from longitudinal centerline 353. Distal ends of arm extensions 358, 360 includes fierce 362, 364, respectively.

Figure 6A:
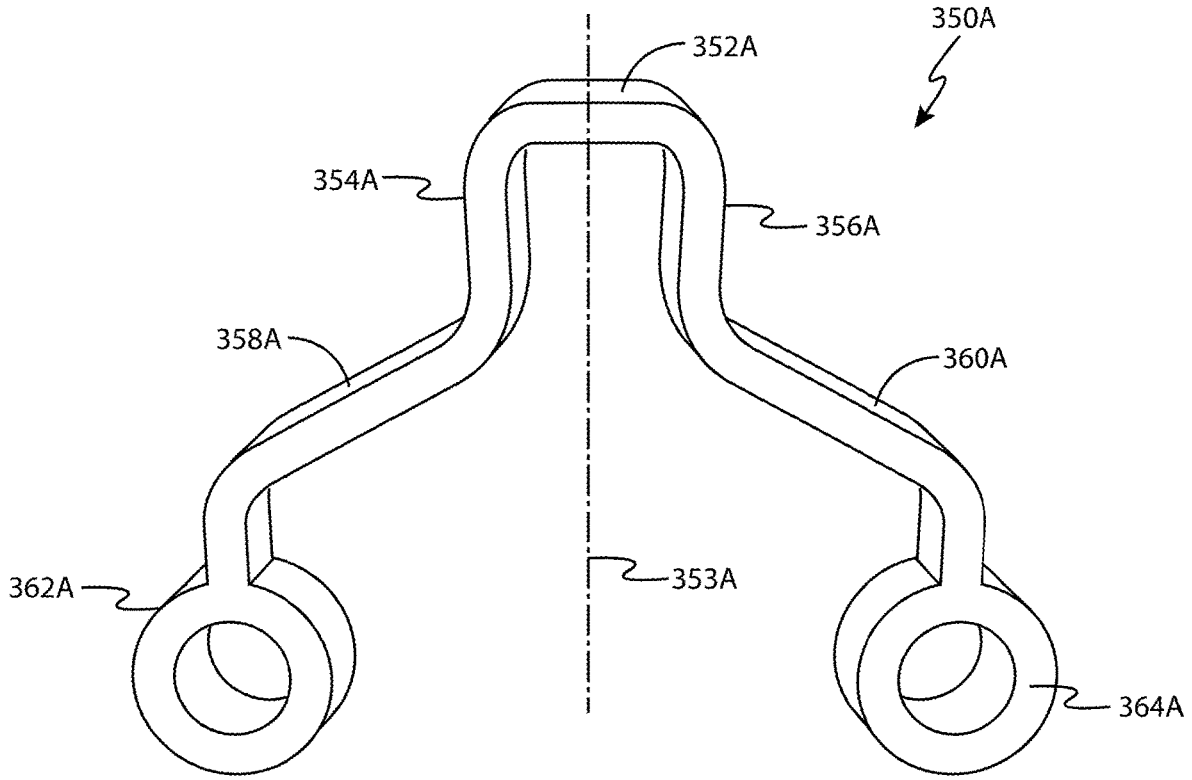
FIG. 6A shows a side elevational view of another alternative exemplary embodiment of a projectile for use with any disclosed embodiment of the launcher/retrieval device according to the present invention.

While spheres 362, 364 are shown, those skilled in the art will recognize that distal ends of arm extensions 358, 360 can include other devices that provide a weight such as, for example projectile 350A shown in FIG. 6A, which includes annular members 362A, 364A, respectively, at the ends thereof. The weights at the end of the projectiles, distal from each apex, are used to balance the projectile when the projectile is seated on its respective launcher/retrieval device and to also balance the projectile when the projectile is in the air.

Figure 7:
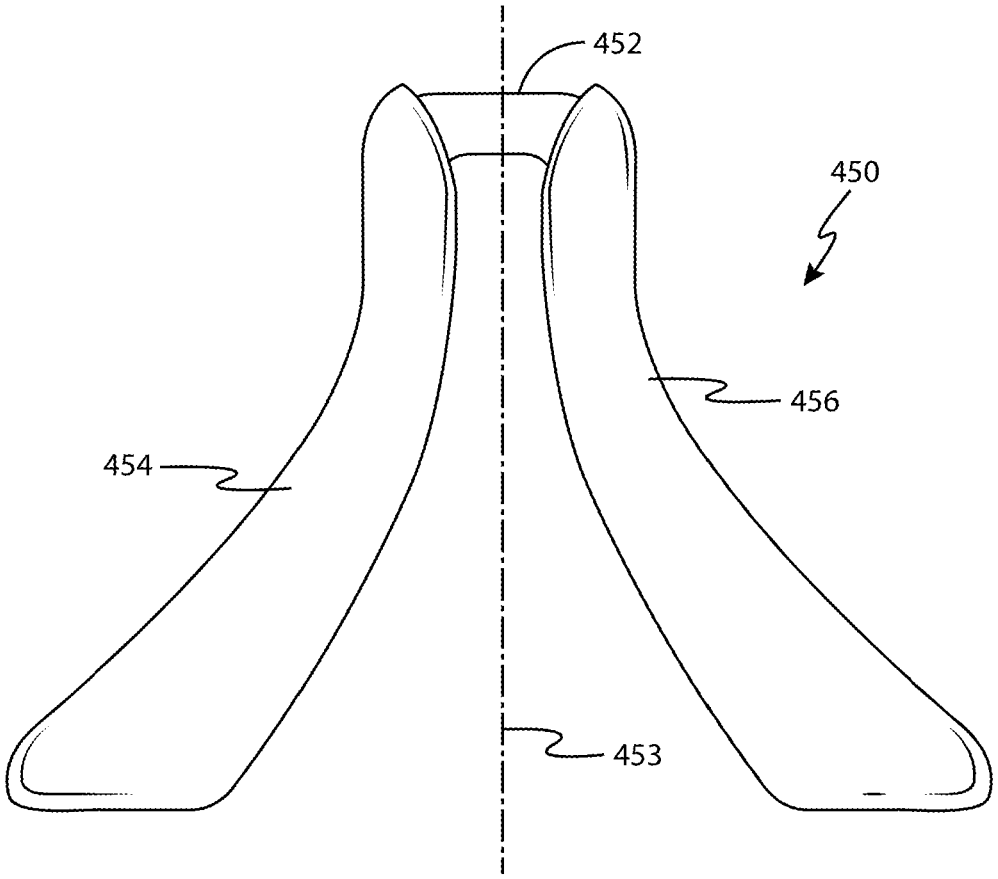
FIG. 7 shows a side elevational view of another alternative exemplary embodiment of a projectile for use with any disclosed embodiment of the launcher/retrieval device according to the present invention.

Referring to FIG. 7, another alternative embodiment of a projectile 450 is shown. Projectile 450 includes a generally flat apex 452 having a length that is about as wide as head 120. A longitudinal centerline 453 bisects projectile 450. Similar to projectile 150, arms 454, 456 are generally curved to extend away from apex 452 and generally diverge away from centerline 453. In an exemplary embodiment, arms, 454, 456 are at least partially coated or covered with a soft material, such as, for example, a foam padding so that, in the event that projectile 450 strikes a person, projectile 450 has a low tendency to be able to injure the person. Additionally, the foam padding provide a soft grip for an animal, such as, for example, a dog, to pick up projectile 450 with its mouth after projectile 450 has been launched by launcher/retrieval device.

Figure 8:
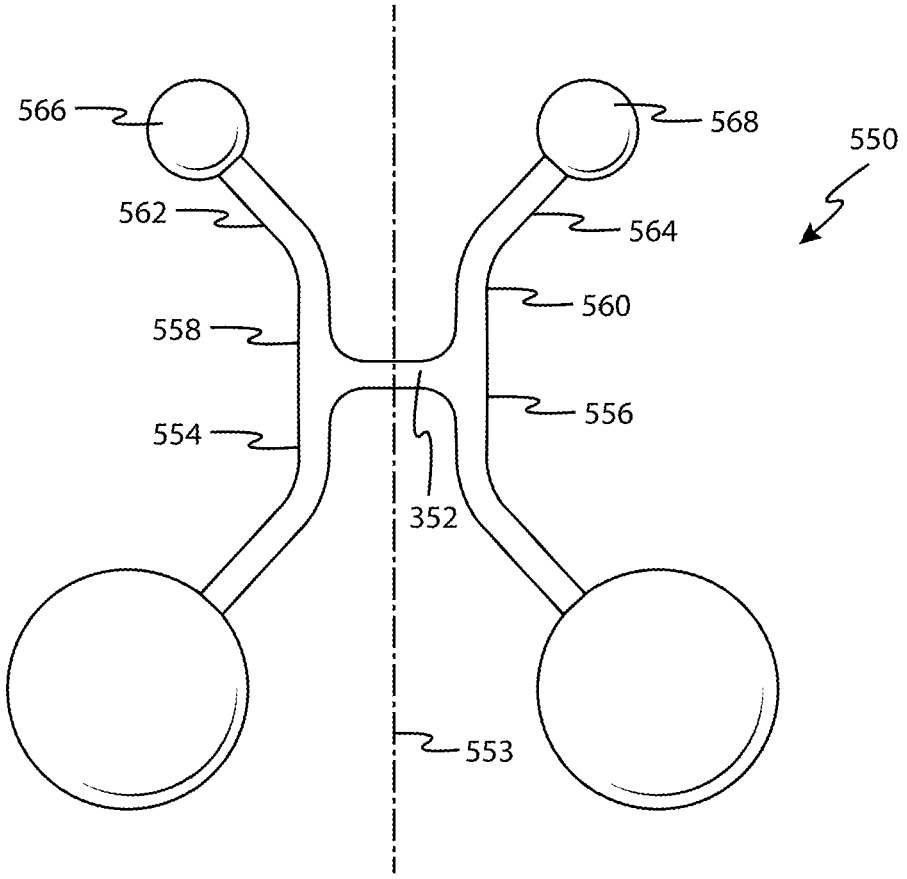
FIG. 8 shows a side elevational view of another alternative exemplary embodiment of a projectile for use with any disclosed embodiment of the launcher/retrieval device according to the present invention.
Figure 9:
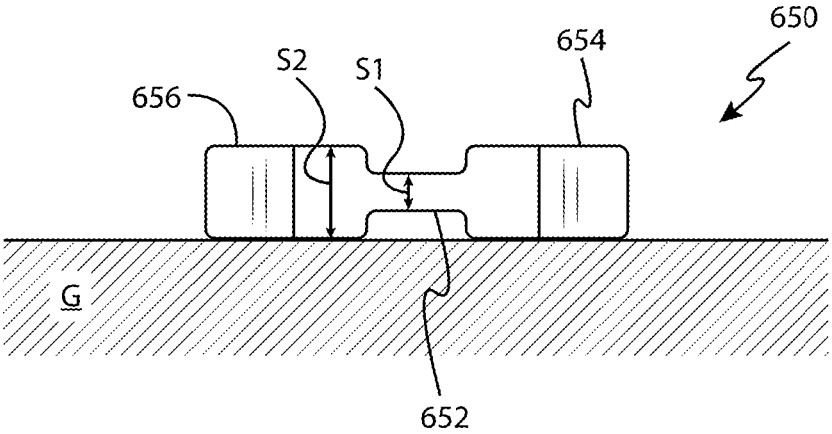
FIG. 9 shows a front elevational view of another alternative exemplary embodiment of a projectile for use with any disclosed embodiment of the launcher/retrieval device, with the projectile lying on the ground, according to the present invention.

FIG. 8 shows still another alternative embodiment of a projectile 550. Projectile 550 is similar to projectile 350, with the exception that, at apex 552, in addition to arms 554, 556 that extend generally parallel to a longitudinal centerline 553 in one direction, a second set of arms 558, 560 extend away from apex 552 in an opposing direction. Arm extensions 562, 564 extend from their respective arms 558, 560 away from longitudinal centerline 553, and terminate in counterweights 566, 568, respectively. Counterweights 566, 568. Add balance to projectile 550. While projectile 550 is in flight. Additionally, counterweights 566, 568 also serve to lift apex 552 of the ground when projectile 550 itself is on the ground, making it easier to slide first free end 124 of head 120 underneath apex 552 to engage projectile 550 and lift projectile 550 from the ground.

In an alternative embodiment of any of the projectiles described above, a projectile 650, shown in FIG. 9 includes an apex 652 that has a narrow cross-section S1, that is smaller than the cross-section S2 of arms 654, 656 such that, when projectile 650 is lying on the ground G, a space is formed between ground G and apex 652, enabling first free end 124 of head 120 to be able to slide underneath apex 652 to engage projectile 650 and lift projectile 650 from ground G.

In still another alternative embodiment of any of the projectiles described above, a projectile 750, shown in FIG. 10, includes pins 760, 762 that extend outwardly from each of the arms of projectile 750 (only arm 754 is shown). Pins 760, 762 are located proximate to apex 752 and serve to lift apex 752 away from ground G such that, when projectile 750 is on ground G, a space is formed between ground G and apex 752, enabling first free end 124 of head 120 to be able to slide underneath apex 752 to engage projectile 750 and lift projectile 750 from ground G.

Figure 10:
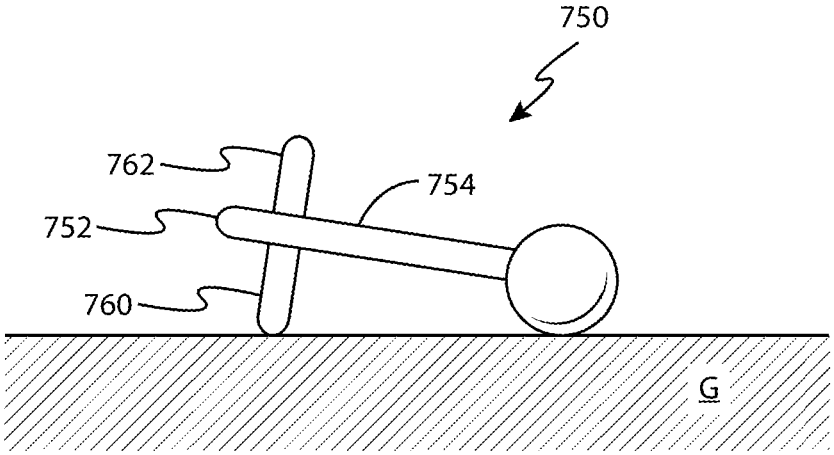
FIG. 10 shows a front elevational view of still another alternative exemplary embodiment of a projectile for use with any disclosed embodiment of the launcher/retrieval device, with the projectile lying on the ground, according to the present invention.
Figure 10A:
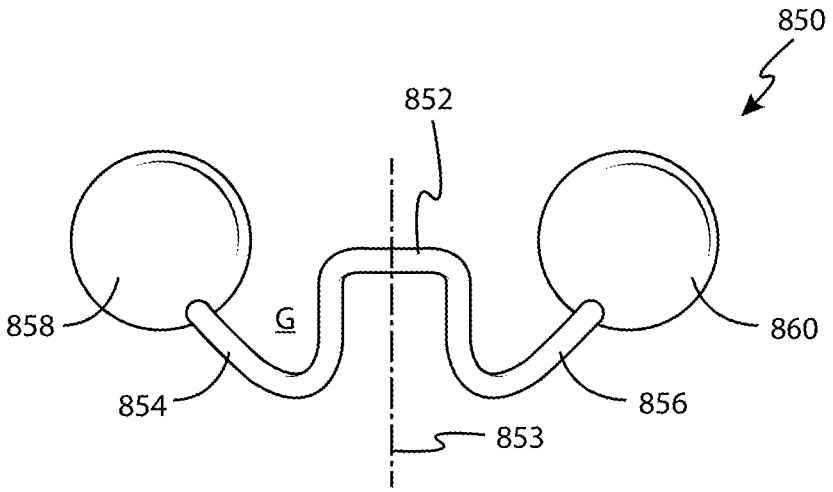
FIG. 10A shows a rear perspective view of still another alternative exemplary embodiment of a projectile for use with any disclosed embodiment of the launcher/retrieval device, with the projectile lying on the ground, according to the present invention.
Figure 10B:
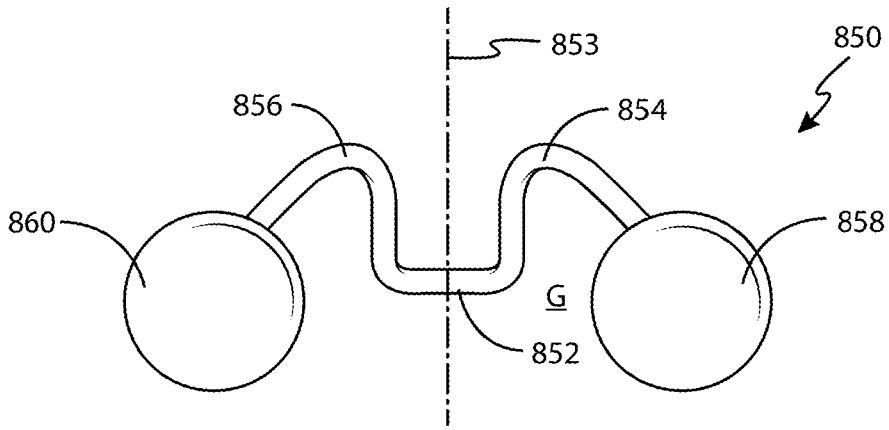
FIG. 10B shows a rear perspective view of the projectile shown in FIG. 10A, with the projectile lying upside down on the ground.

FIGS. 10A and 10B show another alternative embodiment of a projectile 850 according to the present invention. Projectile 850 includes an apex, 852 and arms 854, 856, respectively that extend downwardly and away from apex 852 and a central axis 853 in a curved fashion. Balls 858, 860 are provided on the end of each arm 854, 856, respectively. As shown in FIG. 10A, projectile 850 can land on the ground G with apex 852 extended away from ground G or, alternatively, as shown FIG. 10B, projectile 850 can land on the ground G with apex 852 are engaged with the ground G.

Figure 10C:
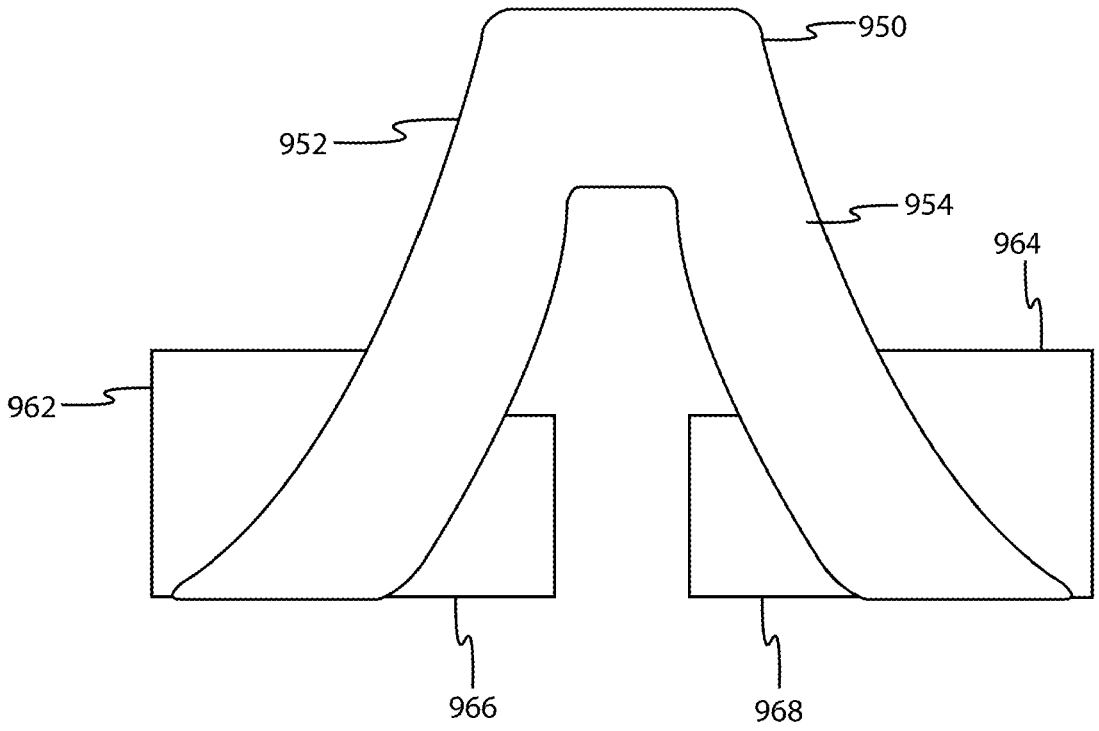
FIG. 10C shoes a front elevational view of still another alternative exemplary embodiment of a projectile for use with any disclosed embodiment of the launcher/retrieval device according to the present invention.

FIG. 10C shows still another alternative exemplary embodiment of a projectile 950 according to the present invention. Projectile 950 is similar in construction to projectile 150, with the exception that projectile 950 includes at least one of fins 962-968 that extend from either or both of legs 952, 954. Fins 962, 964 extend outwardly away from the other of leg 952, 954, while fins 966, 968 extend inwardly toward the other of leg 952, 954. Fins 962-968 can act as rudders and can be bent outwardly from the plane of the paper of FIG. 10C so that fins 962-968 can "steer" projectile 950 in a curved direction away from a plane of launch during flight.

Optionally, any one of the launcher/retrieval devices and/or projectiles disclosed in this application can be provided with a lighting source, such as a luminescent coating, on at least part of launcher/retrieval device and/or projectile to enable launcher/retrieval device and/or projectile to be seen in the dark.

Still alternatively, passages and/or channels can be provided in any launcher/retrieval device, such as, for example, along the length of handle 110 and/or head 120 to allow for the removable insertion of a light source, such as a glow stick. Further, passage and/or channels can also be provided in any projectile, such as, for example, along the length of arms 154, 156 to allow for the removable insertion of a glow stick. The use of glow sticks with the present invention allows the present invention to be used in the dark. The removability of glow sticks allows used close sticks to be removed while allowing new glow sticks to be inserted into launcher/retrieval device and/or projectile.

Figure 13:
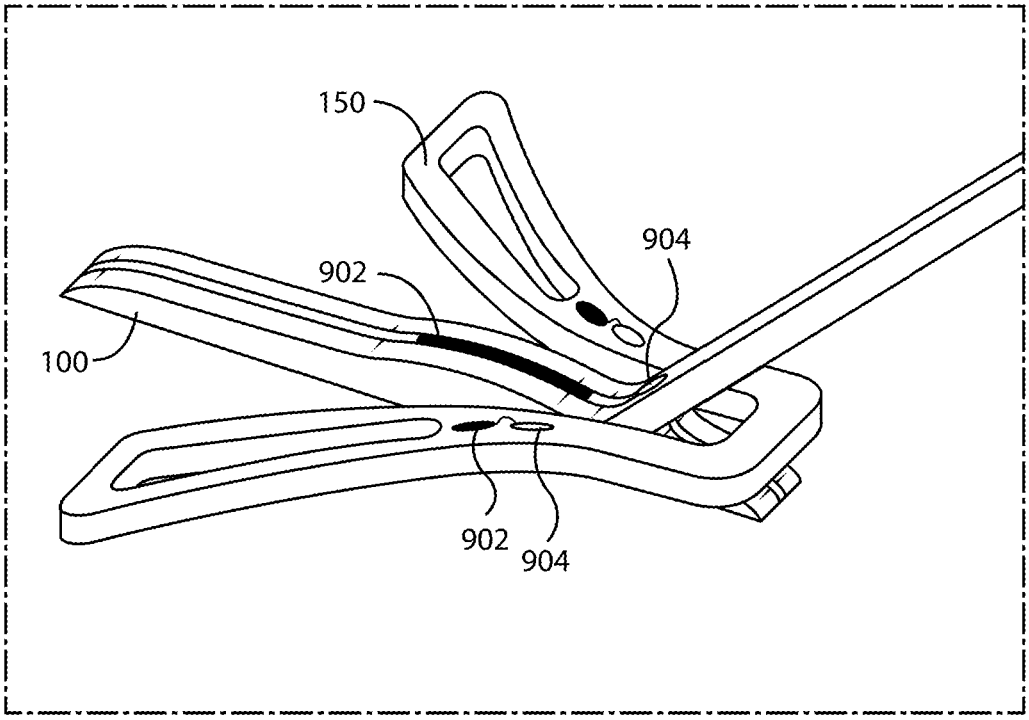
FIG. 13 shows a side elevational view of a launcher/retrieval device according to an exemplary embodiment of the invention, using an electrically powered light to illuminate the device.

While glow sticks can be used to light up launcher/retrieval device 100 and/or projectile 150, those skilled in the art will recognize that other light sources, such as, for example, LED lights 902, as shown in FIG. 13 can be used. LED lights 902 are powered by a battery 904 or other power source located in launcher/retrieval device 100 and/or projectile 150.

Figure 11:
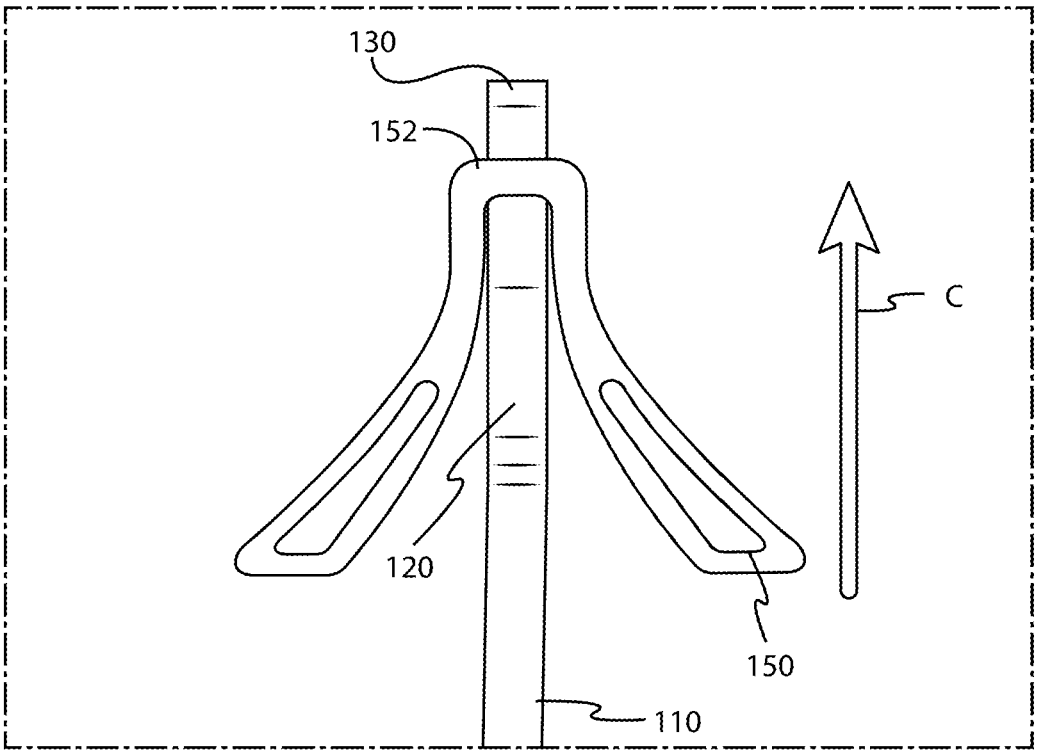
FIG. 11 shows a top plan view of a first method of using the launcher/retrieval device according to any exemplary embodiment of the present invention to pick up any of the projectiles according to the exemplary embodiments of the present invention.

FIG. 11 shows an exemplary method of picking a projectile 150 with launcher/retrieval device 100. First free end 124 is slid underneath apex 152 in the direction of arrow C such that upward end 130 of free end 124 to lift apex 152 and allows head 120 to slide underneath apex 152. Projectile 150 is retained on head 120 in concave receiver 134 between hump 132 and bottom end 114 of handle 110.

Figure 12:
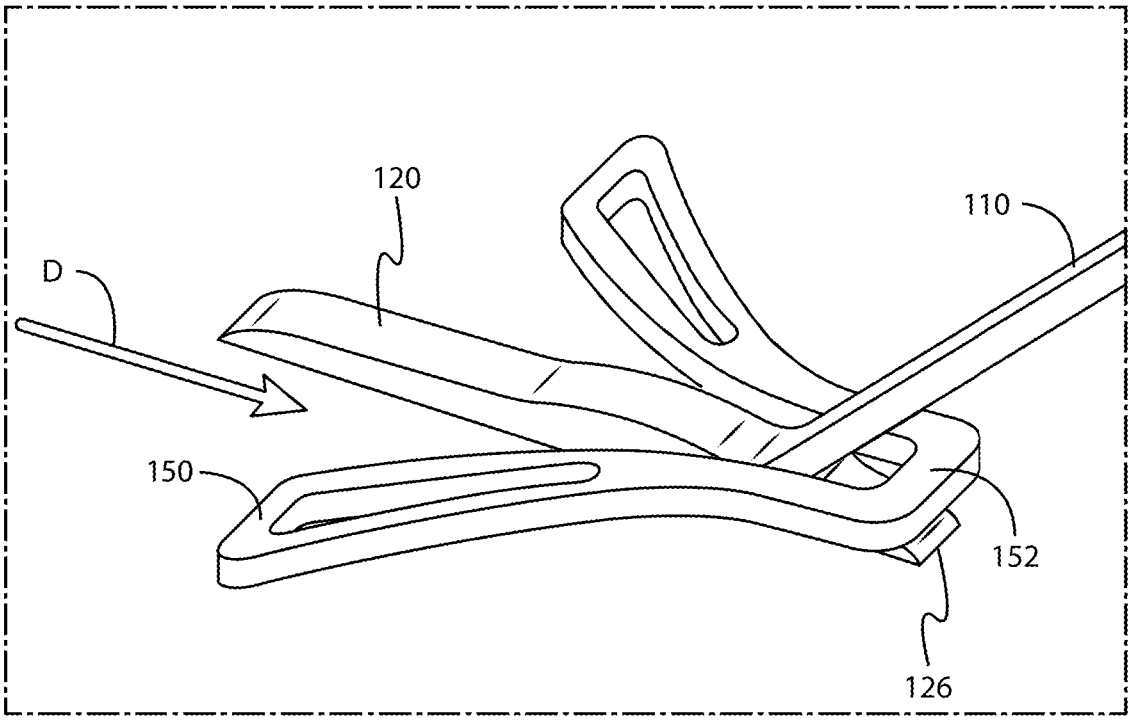
FIG. 12 shows a top plan view of a second method of using the launcher/retrieval device according to any exemplary embodiment of the present invention to pick up any of the projectiles according to the exemplary embodiments of the present invention.

FIG. 12 shows an exemplary embodiment of an alternative method of picking up projectile 150. A second free end 126 is slid underneath apex 152 in the direction of arrow D until apex 152 engages bottom end 114 of handle 110. Projectile 150 is lifted off of the surface by handle 110, and the longitudinal axis of handle 110 is rotated such that apex 152 ends up in concave receiver 134 between hump 132 and bottom end 114 of handle 110.

All of the exemplary embodiments of the launcher/retrieval device and the projectile are each constructed from a rigid material. An exemplary material can be a polymer, such as, for example, ultrahigh molecular weight (UHMW) polymer, although those skilled in the art will recognize that other materials can be used. Optionally, the apex of each projectile can include a magnet or a magnetically attractive material, while the concave receiver in each launcher/retrieval device can include the other of the magnet or magnetically attractive material, such that, when the projectile is being caught with handle 110, the projectile will more naturally gravitate toward the concave receiver.

With projectile 150 nestled in receiver 134, a user can use handle 110 to launch projectile 150 far away from the user, such as, for example, to another user with another handle 110, for the other user to catch projectile 150 with handle 110 or, alternatively, an animal, such as a dog, to chase projectile 150 and retrieve projectile 150.

In an alternative method, the user can merely flip projectile 150 into the air proximate to the user and then catch projectile 150 with handle 110.

Figure 14A:
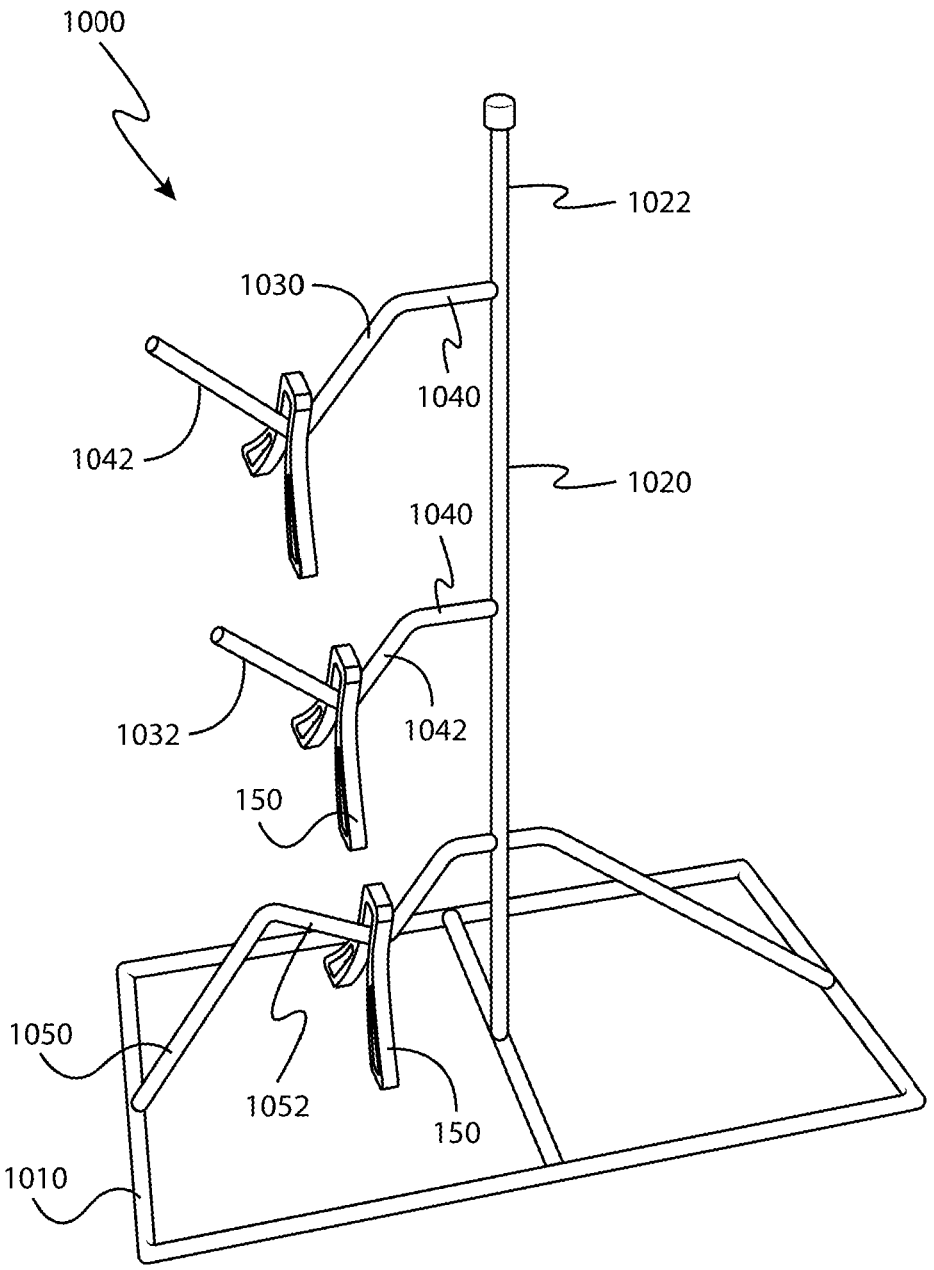
FIG. 14A is a right side perspective view of a frame that is used to catch projectiles according to an exemplary embodiment of the present invention.
Figure 14B:
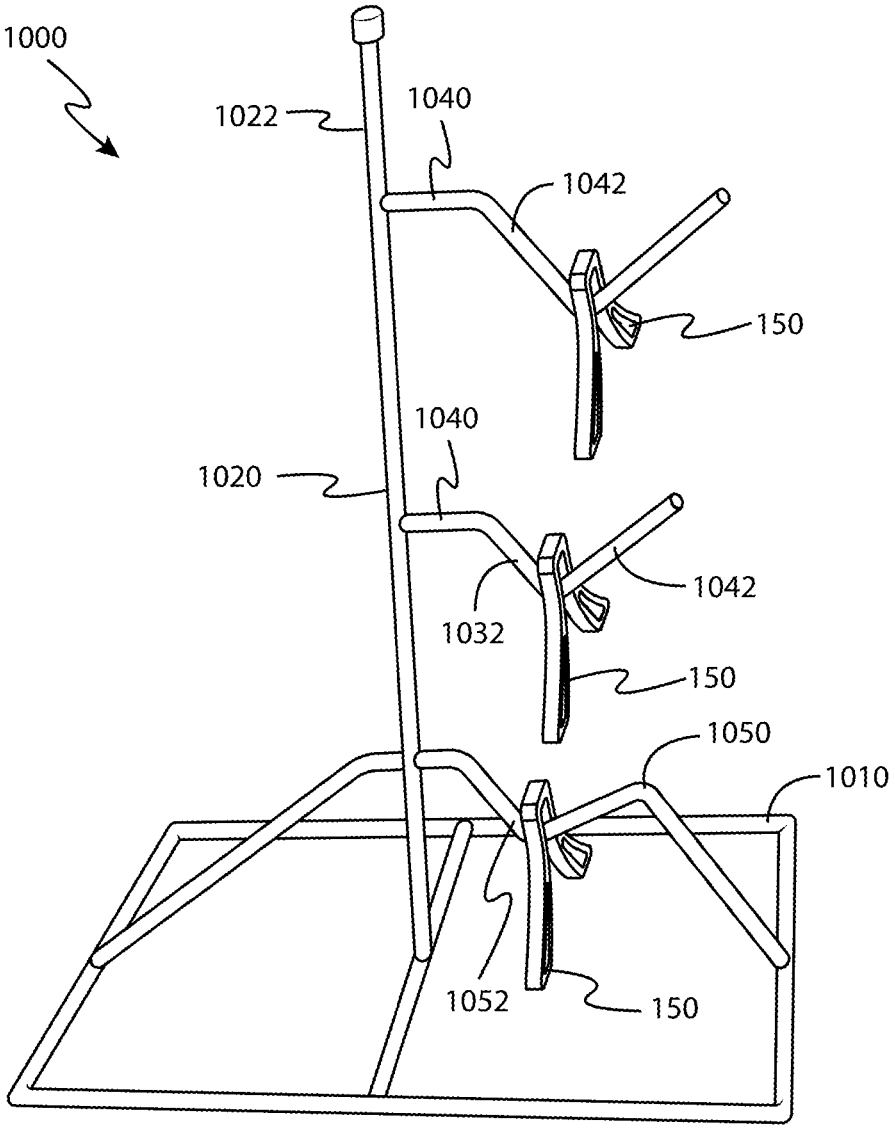
FIG. 14B is a left side perspective view of the frame shown in FIG. 14A.

Any embodiment of launcher/retrieval device 100 using any disclosed launcher and/or projectile can be used to play a game similar to the known game of "Ladderball". Referring to FIGS. 14A and 14B, a frame 1001 can be provided that is used to "catch" a projectile 150-950 after being launched by launcher/retrieval device 110. Frame 1001 can include a generally rectangular base 1010 that is placed on ground G. Although a generally rectangular base 1010 is shown, those skilled in the art will recognize that base 1010 can be generally any shape.

A tower 1020 extends upwardly from base 1010. Tower 1020 includes vertical support 1022 and a plurality of arms 1030, 1032 that extend outwardly from vertical support 1022. Arms 1030, 1032 are coplanar and extend generally in a plane that is coplanar with a plane of flight of a projectile 150-950 that is launched at tower 1020. While two arms 1030, 1032 are shown, those skilled in the art will recognize that more or less than two arms 1030, 1032 can be provided.

Each arm 1030, 1032 includes a connected portion 1040 that extends generally orthogonal to vertical support 1022. A generally "V-shaped" receiver 1042 extends outwardly from connected portion 1040 such that a projectile 150-950 can be "caught" in the crux of the "V", as shown in FIGS. 14A and 14B.

Optionally, a stabilizer 1050 can extend outwardly from vertical support 1022 and connect to a forward portion of base 1010. A generally "V-shaped" receiver 1052 can be formed in stabilizer 1050 such that a projectile 150-950 can be "caught" in the crux of the "V", as is also shown in FIGS. 114A and 14B.

Figure 15:
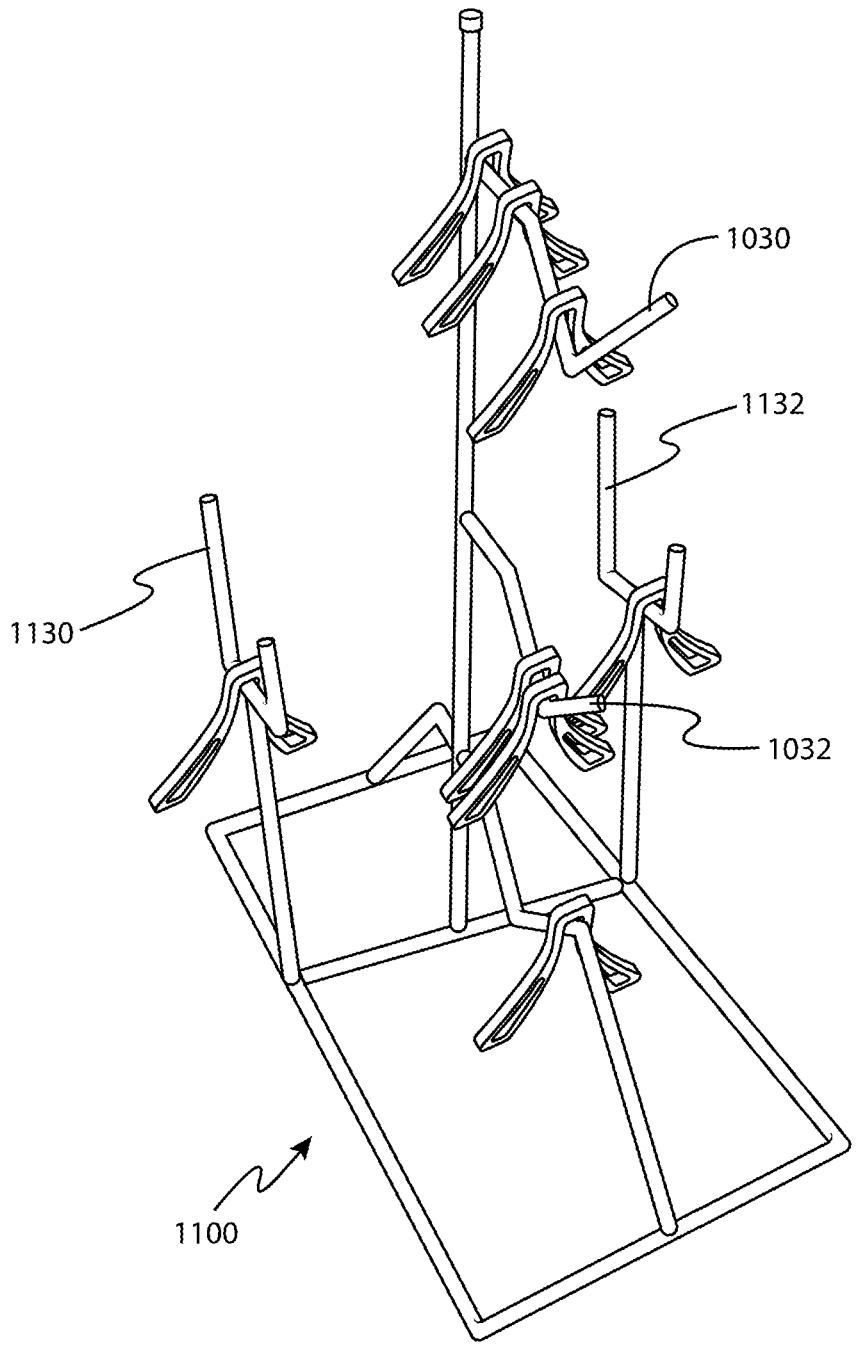
FIG. 15 is a left side perspective view of a frame that is used to catch projectiles according to another exemplary embodiment of the present invention.
Figure 16:
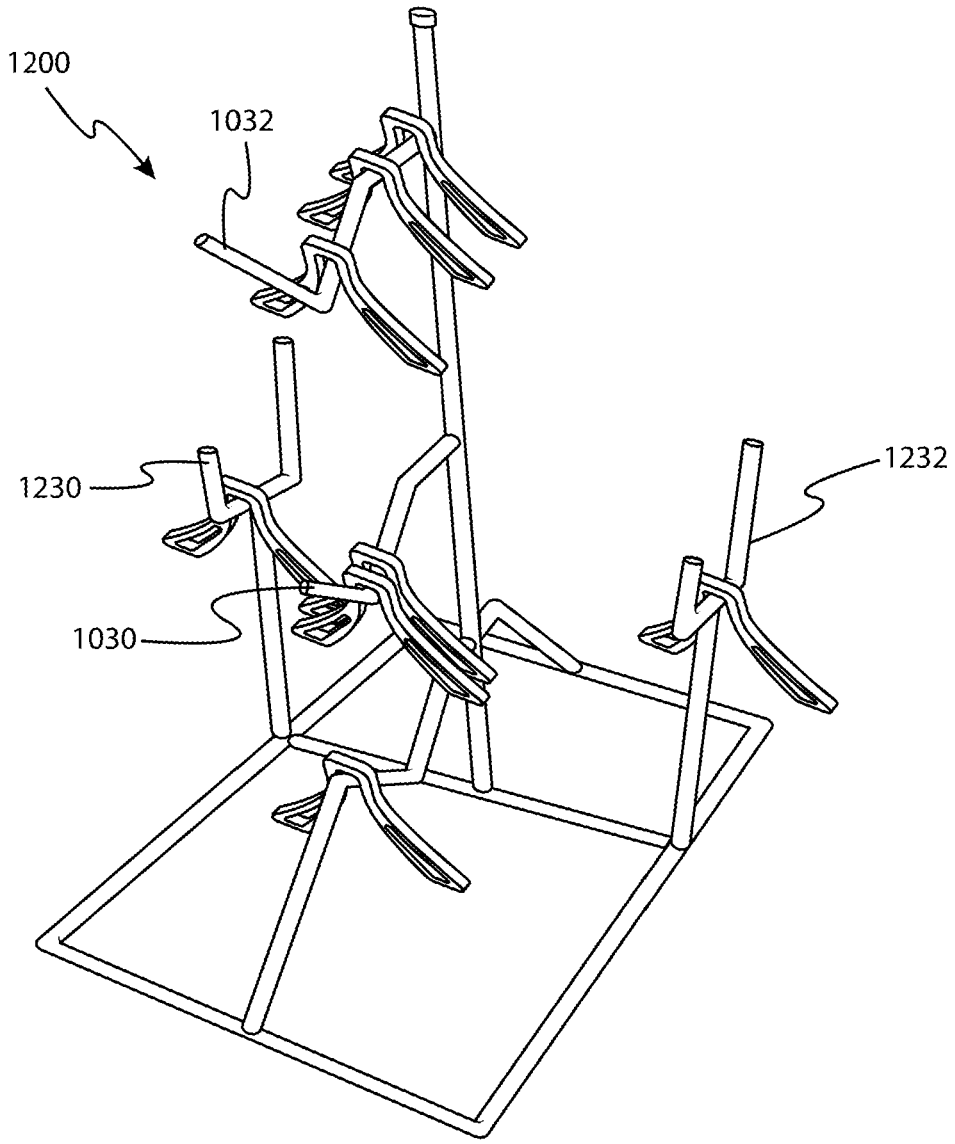
FIG. 16 is a right side perspective view of a frame that is used to catch projectiles according to still another exemplary embodiment of the present invention.

Referring to FIGS. 15 and 16, other configurations of frames 1100, 1200, respectively, can be provided that can be used to "catch" projectiles 150-950 in a manner similar to frame 1001. Each of frame 1100, 12200 is similar to frame 1001, but frames 1100, 1200 each also has arms 1130, 1132 and 1230, 1232, respectively, that have generally "U-shaped" receivers, such that each receiver 1130, 1132, 1230, 1232 extends in its own plane, generally parallel to the plane of arms 1030, 1032. While two alternate embodiments of frames 1100, 1200 are shown, those skilled in the art will recognize that other combinations and configurations of frames can be used.

With respect to any of frames 1001, 1100, 1200, points can be awarded for each successful "catch" of a projectile on a receiver, with different receivers being worth different point values.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A flip toy assembly comprising:

a launcher having:

an elongate handle having:

a top end; and a bottom end, distal from the top end; and a head fixedly attached to the bottom end, the head comprising:

a connector portion connected to the handle;

a first free end portion extending from the connector portion away from the handle, the first free end portion having:

a pointed tip, distal from the connector portion;

a generally sloped upward portion adjacent to the tip;

a flattened intermediate portion adjacent to the generally sloped upward portion;

a convex hump extending above and connected to the flattened intermediate portion; and a concave receiver disposed between the convex hump and the connector portion;

a second free end extending from the bottom end in a direction away from the first free end portion; and a bottom end of the head extending in a straight line an entire length from the tip to the second free end wherein the handle further comprises a hook mounted on the handle between the top end of the handle and the bottom end of the handle, the hook extending downwardly toward the second free end of the head; and a projectile having:

an apex having a first side and a second side;

a first leg extending away from the first side of the apex; and a second leg extending away from the second side of the apex.

2. The flip toy assembly according to claim 1, wherein the second free end slopes upwardly toward the connector portion.

3. The flip toy assembly according to claim 1, wherein each of the first leg and the second leg comprises a counterweight located distal from the apex.

4. The flip toy assembly according to claim 1, wherein each of the first and second legs includes a light source.

5. The flip toy assembly according to claim 4, wherein the first leg extends generally in a plane that is orthogonal to a plane of flight of the projectile.

6. The flip toy assembly according to claim 1, further comprising a frame adapted to receive and retain the projectile, the frame comprising:

a vertical support; and a first arm extending outwardly from the vertical support, the first arm configured to receive and retain the projectile.

* * * * *